US007607480B2

(12) United States Patent
Domingue et al.

(10) Patent No.: US 7,607,480 B2
(45) Date of Patent: Oct. 27, 2009

(54) METHOD FOR REPAIR OF DAMAGED WELLS

(76) Inventors: Clayton John Domingue, P.O. Box 53508, Lafayette, LA (US) 70505; Loren Scott Truby, 19711 Ivory Mills La., Houston, TX (US) 77094

( * ) Notice: Subject to any disclaimer, the term of this patent is extended or adjusted under 35 U.S.C. 154(b) by 11 days.

(21) Appl. No.: 11/986,870

(22) Filed: Nov. 27, 2007

(65) Prior Publication Data

US 2009/0133873 A1 May 28, 2009

(51) Int. Cl.
*E21B 29/00* (2006.01)

(52) U.S. Cl. ..... 166/277; 166/344

(58) Field of Classification Search ..... 166/85.1, 166/85.5, 191, 196, 277, 339, 344, 379, 380; 405/156, 184.1, 216, 228; 175/10
See application file for complete search history.

(56) References Cited

U.S. PATENT DOCUMENTS 2,963,090 A * 12/1960 Focht et al. ..... 33/645
3,321,924 A * 5/1967 Liddell ..... 405/216
3,890,794 A * 6/1975 Broadfoot ..... 405/216
4,526,232 A * 7/1985 Hughson et al. ..... 166/339
4,538,684 A * 9/1985 Sheffield ..... 166/277
4,733,732 A * 3/1988 Lynch ..... 175/9
5,297,638 A * 3/1994 Dolence, Jr. ..... 175/61
5,370,183 A * 12/1994 Ellis et al. ..... 166/277
6,247,541 B1 * 6/2001 Ellis et al. ..... 175/9
6,997,260 B1 * 2/2006 Trader et al. ..... 166/277
2006/0260809 A1 * 11/2006 Crain ..... 166/277
2007/0199716 A1 * 8/2007 Ruttley et al. ..... 166/338

* cited by examiner

*Primary Examiner*—Jennifer H Gay
*Assistant Examiner*—Blake Michener
(74) *Attorney, Agent, or Firm*—Ted M. Anthony

(57) ABSTRACT

A method for repairing damaged wells, especially in marine environments utilizing an alignment apparatus having a substantially cylindrical body member, a lower spear extension and a plurality of blades extending radially outward from the body member and spear extension. The alignment apparatus is concentrically inserted into the upper opening of a damaged well having a substantially vertical orientation. The alignment apparatus serves as an alignment guide for larger diameter pipe to be installed (typically driven) around a portion of the well to provide structural integrity to the well, as well as to serve as a conduit into the well for subsequent operations.

6 Claims, 7 Drawing Sheets

METHOD FOR REPAIR OF DAMAGED WELLS

BACKGROUND OF THE INVENTION

1. Field of the Invention

The present invention relates to a method for repairing wells, including, but not necessarily limited to, oil and/or gas wells damaged by catastrophic events such as, for example, high winds or collisions with moving vessels. More particularly, the present invention relates to a method for installing pipe over damaged wells in order to reclaim said wells. More particularly still, the present invention relates to a method for aligning drive pipe that is to be driven over damaged wells during the reclamation and/or repair of such wells.

2. Description of the Related Art

In many cases, especially in offshore operations, large diameter pipe, (commonly referred to as drive pipe or conductor pipe), is driven into the surface of the earth as one of the initial steps of the well-drilling process. Such drive pipe, which can be driven as deep as several hundred feet into the earth, provides structural integrity for the ongoing drilling process in unconsolidated formations near the earth's surface.

Tubular drive pipe having an internal bore is typically driven into the surface of the earth using a large hammer or similar equipment that acts in much the same way as a pile driver. Such hammers are used to strike the upper surface of the drive pipe in a downward direction, thereby forcing the drive pipe axially into the earth's crust. With each blow of the hammer, the drive pipe advances deeper into the earth's crust until penetration stops, or until a predetermined depth is achieved.

After drive pipe has been driven to a desired depth, a well is typically drilled deeper using conventional drilling methods. Specifically, a drill bit (having an outer diameter smaller than the internal diameter of the drive pipe) is conveyed into the internal bore of the drive pipe on drill pipe or other similar tubular workstring using a drilling rig situated over the drive pipe. A section of hole is then drilled deeper into the earth's crust through the internal bore of the drive pipe and out the bottom of the drive pipe. Once a section of hole has been drilled to a desired depth, a smaller string of pipe known as casing (having an outer diameter smaller than the internal diameter of the drive pipe) is then typically conveyed into the well and cemented in place. Such casing is often installed to provide structural integrity to the well-bore and keep geologic formations isolated from one another.

After a well has been drilled to its desired depth, production tubing and other equipment can be installed in said well. Additionally, surface valves and related equipment, commonly referred to as a "Christmas tree", can be installed on the upper portion of such well. In marine environments, such as offshore or in inland waters, it is often desirable to have access to the Christmas tree and related equipment on a well. For this reason, wells are typically designed so that a Christmas tree (and some length of drive pipe, casing and tubing) is situated above the surface of the water. In such cases, the drive pipe, casing and tubing extend vertically out of the mud-line (that is, the interface between the earth's crust and the water) for some distance. In many cases, the upper portions of such wells are also attached to support structures, such as platforms and the like, which are in turn anchored to the earth's crust.

When a major weather phenomenon or other similar event occurs (such as, for example, a hurricane or severe windstorm) in a marine environment, wells can be severely damaged. Often, such wells get "pushed over"—that is, the wells can bend at or near the mud-line. In such cases, the Christmas trees and other equipment at the upper extent of the wells can frequently lose their vertical orientation. In extreme cases, the Christmas trees can actually be pushed under the surface of the water. Similarly, boats or other vessels can collide with such wells, thereby knocking over the wells. When this occurs, the damaged wells are effectively useless; the wells must be repaired before any production can be achieved from such wells or significant remedial work can be performed on the wells.

Accordingly, it is an object of the present invention to provide a means for repairing and reclaiming wells that have been damaged by severe weather, collision or other catastrophic event.

SUMMARY OF THE INVENTION

The present invention relates to a method and apparatus for repairing damaged wells such as, for example, oil or gas wells. Specifically, such wells are repaired by aligning large diameter pipe over such wells and driving such pipe over a portion of said wells. The alignment apparatus of the present invention comprises an elongate and substantially cylindrical body member having an upper end and a lower end. Although the specific dimensions of said body member can vary, said body member should ideally have sufficient size and weight characteristics to provide adequate strength and rigidity for its intended use.

In the preferred embodiment of the present invention, a substantially planar plate member is mounted to the lower end of said body member, and oriented perpendicular to the longitudinal axis of said body member. An elongate spear member extends from said planar plate member. In the preferred embodiment, said spear member has substantially the same longitudinal axis as said body member, a smaller outer diameter than said body member and at least one tapered surface at its distal end. Additionally, in the preferred embodiment of the present invention, at least one blade member extends radially outward from the outer surfaces of said body member and spear member. In the preferred embodiment, a removable cap is also provided on the upper end of said body member.

In operation, a damaged well—typically a well that has been bent, buckled or twisted at or near the mud-line from severe weather effects, collision with a vessel and/or other catastrophic damaging event—is severed at or near the mud-line using conventional pipe cutting methods that are well known in the art. Such well is beneficially cut at a point above the mud-line where said well retains a substantially vertical orientation. However, in practice, a well may not retain any significant length of vertical orientation above the mud-line and, accordingly, such well must be cut below the mud-line.

Such cutting can be accomplished using any number of different methods well known to those having skill in the art. Further, in many cases (especially when a well is cut below the mud-line), mud and/or other debris surrounding a well is beneficially removed from the area around the outer surface of said well in order to permit access to such well. Frequently, such mud removal and cutting operations are performed by divers, remote operated equipment, and/or some combination of divers and equipment.

As set forth above, many wells consist of multiple concentric strings of drive pipe, casing, tubing and/or other pipe. In most cases, all of the concentric pipe strings present at a desired cut point in a well will be severed at such depth. Accordingly, the original drive pipe (which typically constitutes the outermost string of pipe of a well), as well as any casing and/or tubing strings situated within said drive pipe, are all cut at such depth. Following such cut, the upper end of said well comprises a substantially cylindrical pipe member (or group of concentric pipe members) having an upward-facing opening.

Once a well has been cut at a desired depth, the alignment apparatus of the present invention is typically "stabbed" into the upper opening of said well. Such alignment apparatus can be handled and/or manipulated using a crane, hoist or other similar lifting equipment. However, in most cases, it is beneficial to use a drilling rig or other similar apparatus that is situated above the subject well, for reasons set forth in detail below.

Although it may be possible to steer the elongate spear member of said alignment apparatus into the upper opening of said well, in many cases it is necessary to employ divers, remote-operated equipment, or some combination thereof, to position the alignment apparatus over said well and guide the spear member into the upper opening of said well. In most cases, the alignment apparatus of the present invention (and, more particularly, the elongate spear member) is received within said well until said planar plate member contacts the upper surface of said well (which is typically where the pipe was cut). In this configuration, the alignment apparatus of the present invention extends vertically upward from the upper surface of said well.

After the alignment apparatus of the present invention is stabbed into the upper opening of said well as set forth above, large diameter pipe (that is, pipe having an internal diameter sufficiently large to fit over both the alignment apparatus of the present invention and the original drive pipe of the well) is driven over said alignment apparatus and well. In most cases, such large diameter pipe is driven using a conventional drilling rig or other similar equipment situated over the well. During the pipe driving operation, the alignment apparatus serves as a guide to align such large diameter pipe over the upper portion of the well.

After the drive pipe has been driven over the upper portion of the well, the alignment apparatus of the present invention (which would be located within such drive pipe) is retrieved. Such new drive pipe provides a conduit into the well from a rig or other surface equipment for reclamation activities such as, for example, downhole operations. Additionally, such new drive pipe provides structural integrity to the well to support future utility of such well.

DESCRIPTION OF THE PREFERRED EMBODIMENT(S)

Figure 1:
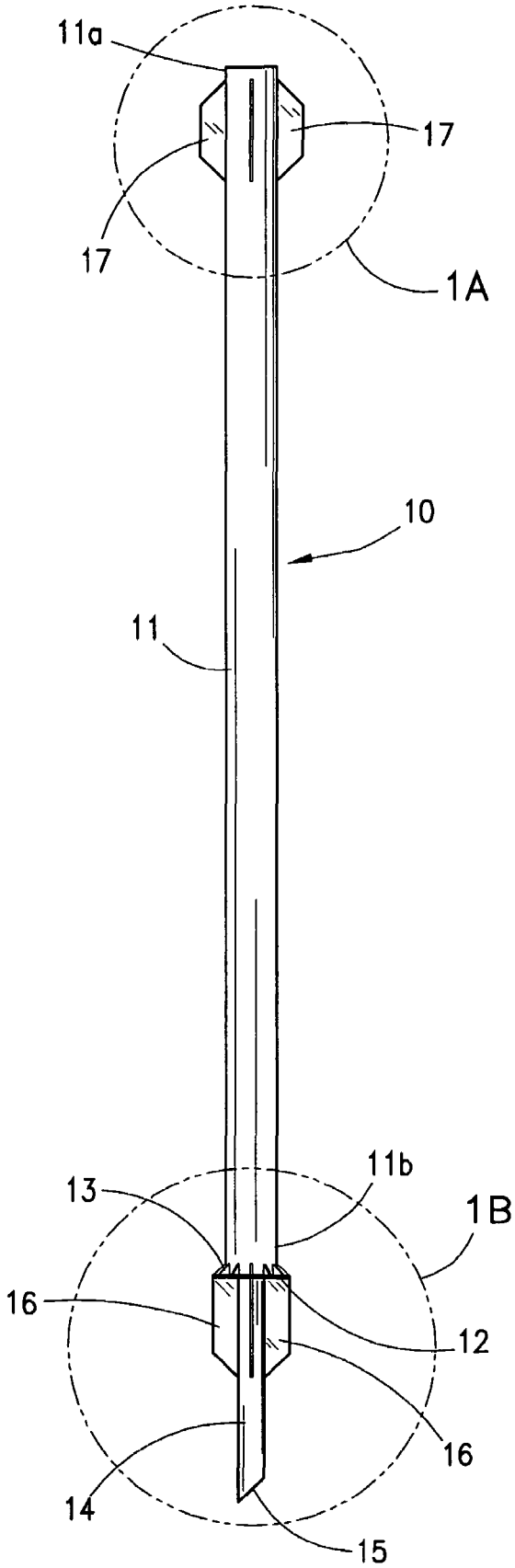
FIG. 1 depicts a side view of an alignment apparatus of the present invention.

Referring to the drawings, the present invention relates to a method and apparatus for repairing damaged oil or gas wells by the alignment and installation of large diameter pipe over a portion of such wells near the upper extent of such wells. FIG. 1 depicts an alignment apparatus 10 of the present invention. Alignment apparatus 10 comprises an elongate and substantially cylindrical body member 11 having an upper end 11*a* and a lower end 11*b*. In the preferred embodiment of the present invention, substantially planar plate member 12 is mounted to lower end 11*b* of said body member, wherein said substantially planar plate member is oriented substantially perpendicular to the longitudinal axis of said body member 11. In the preferred embodiment, said body member 11 comprises a substantially hollow pipe having dimensions, strength, weight and other physical characteristics beneficial for the desired application as set forth herein. A plurality of support fins 13 extend radially outward along the outer surface of body member 11, thereby connecting said body member to planar plate member 12 and providing support for said plate member 12.

Elongated spear member 14 extends from the base of said planar plate member 12. In the preferred embodiment, said elongated spear member 14 has substantially the same longitudinal axis as said body member 11, a smaller outer diameter than said body member 11 and at least one tapered surface 15 at its distal end. Said tapered surface 15 forms a configuration commonly referred to in the oil and gas industry as a "mule shoe". Additionally, in the preferred embodiment of the present invention, a plurality of blade members 16 extend radially outward from the outer surface of said spear member 14.

Figure 1A:
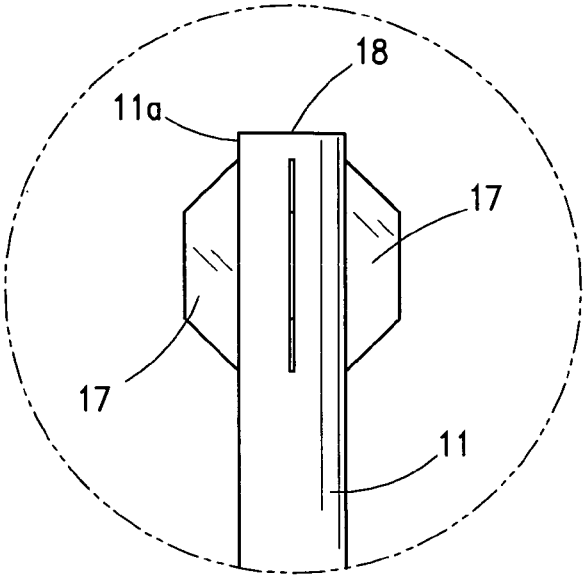
FIG. 1A depicts a detailed side view of the upper portion of the alignment apparatus depicted in FIG. 1.

FIG. 1A depicts a detailed side view of the upper portion 11*a* of body member 11 of alignment apparatus 10 depicted in FIG. 1. As shown in FIG. 1A, in the preferred embodiment, a plurality of blade members 17 extend radially outward from the outer surface of body member 11 of alignment apparatus 10. Additionally, at least one notch 18 is disposed along upper portion 11*a* of body member 11.

Figure 1B:
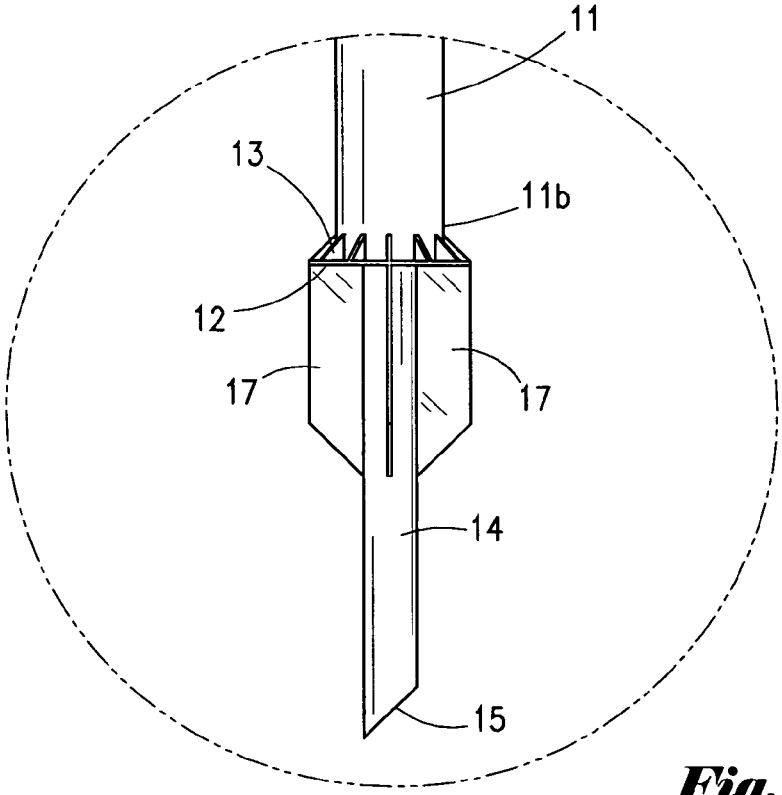
FIG. 1B depicts a detailed side view of the lower portion of the alignment apparatus depicted in FIG. 1.

FIG. 1B depicts a detailed side view of lower portion 11*b* of body member 11 of alignment apparatus 10 depicted in FIG. 1. In FIG. 1B, substantially planar cylindrical plate member 12 is mounted to the lower end 11*b* of said body member 11, wherein said substantially planar plate member 12 is oriented substantially perpendicular to the longitudinal axis of said body member 11. In the preferred embodiment, a plurality of support fins 13 extend along the outer surface of body member 11, connecting the outer surface of body member 11 to the upper surface of plate member 12, and providing structural support to planar plate member 12. Elongated spear member 14 extends from said planar plate member 12 and has substantially the same longitudinal axis as said body member 11. Additionally, in the preferred embodiment of the present invention, a plurality of blade members 16 extend radially outward from the outer surface of said spear member 14. Spear member 14 also has at least one tapered surface 15 or "mule shoe" at its distal end.

Figure 2:
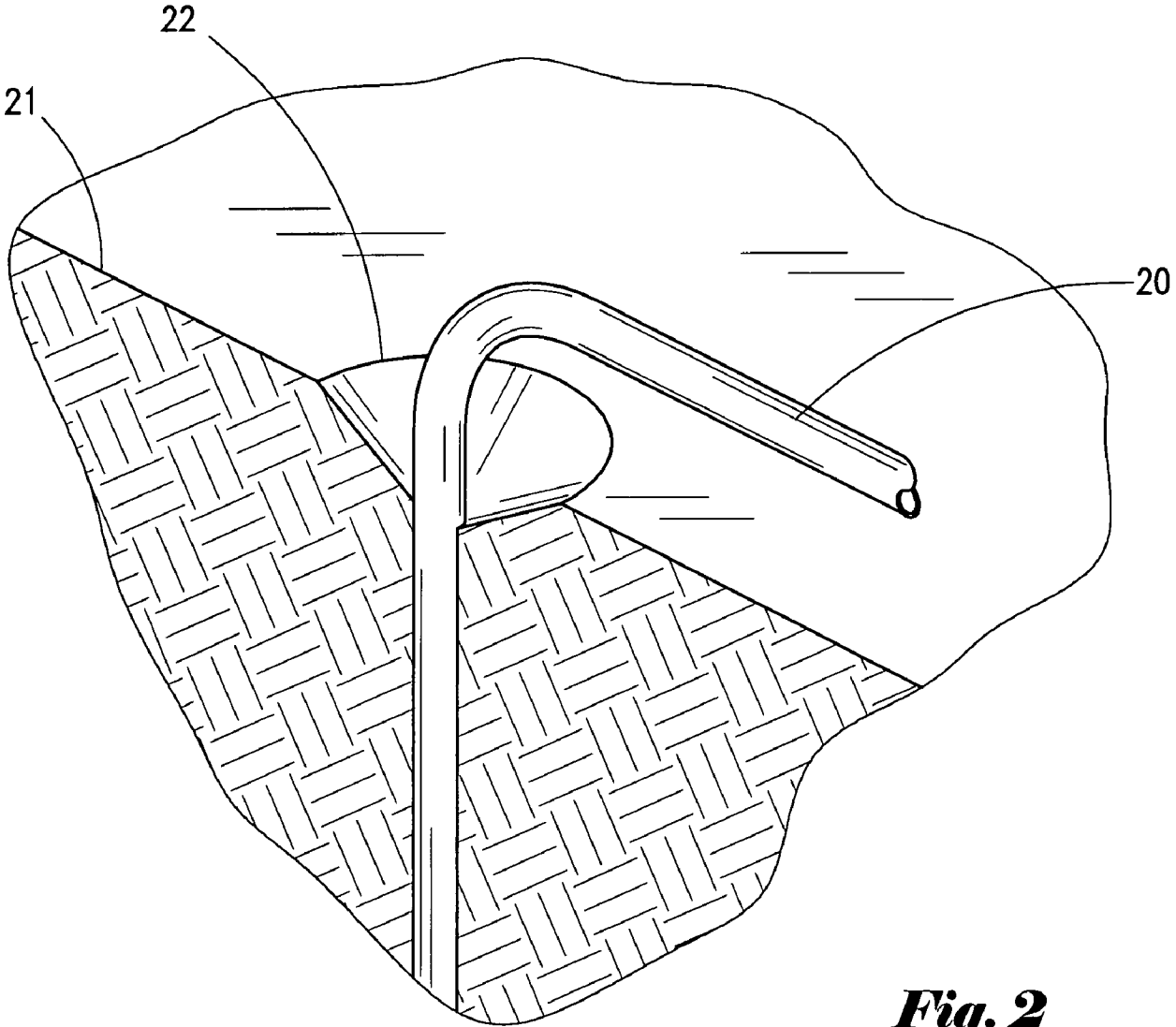
FIG. 2 depicts an overhead perspective sectional view of a damaged well situated in a marine environment.

FIG. 2 depicts an overhead perspective view of a damaged well 20 situated in a marine environment. Well 20 extends downward into the earth's crust below mud-line 21 (wherein the term mud-line is defined as the interface between the earth's crust and overlying water). Damaged well 20 as depicted in FIG. 2 has been bent, buckled and/or twisted at or near mud-line 21 from severe weather effects, collision with a vessel and/or other similar event(s). In most cases, damaged well 20 comprises a plurality of concentric pipe strings; however, only the outer-most string is visible in FIG. 2.

In accordance with the method of the present invention, well 20 is severed at or near mud-line 21 using conventional pipe cutting methods that are well known to those having skill in the art. Ideally, well 20 is cut at a point above mud-line 21 where said well retains a substantially vertical orientation. However, in practice, well 21 may not retain any significant length of vertical orientation above mud-line 21 and, accordingly, well 20 must be cut at or below the mud-line. In certain circumstances, well 20 may be moved about by underwater currents or other effects, thereby causing a "coning effect" 22 near mud-line 21 in the immediate vicinity of well 20, which provides access to a vertical section of well 20. In some cases, the coning effect is not present, and some amount of mud or other solids must be removed from the area around well 20.

Figure 3:
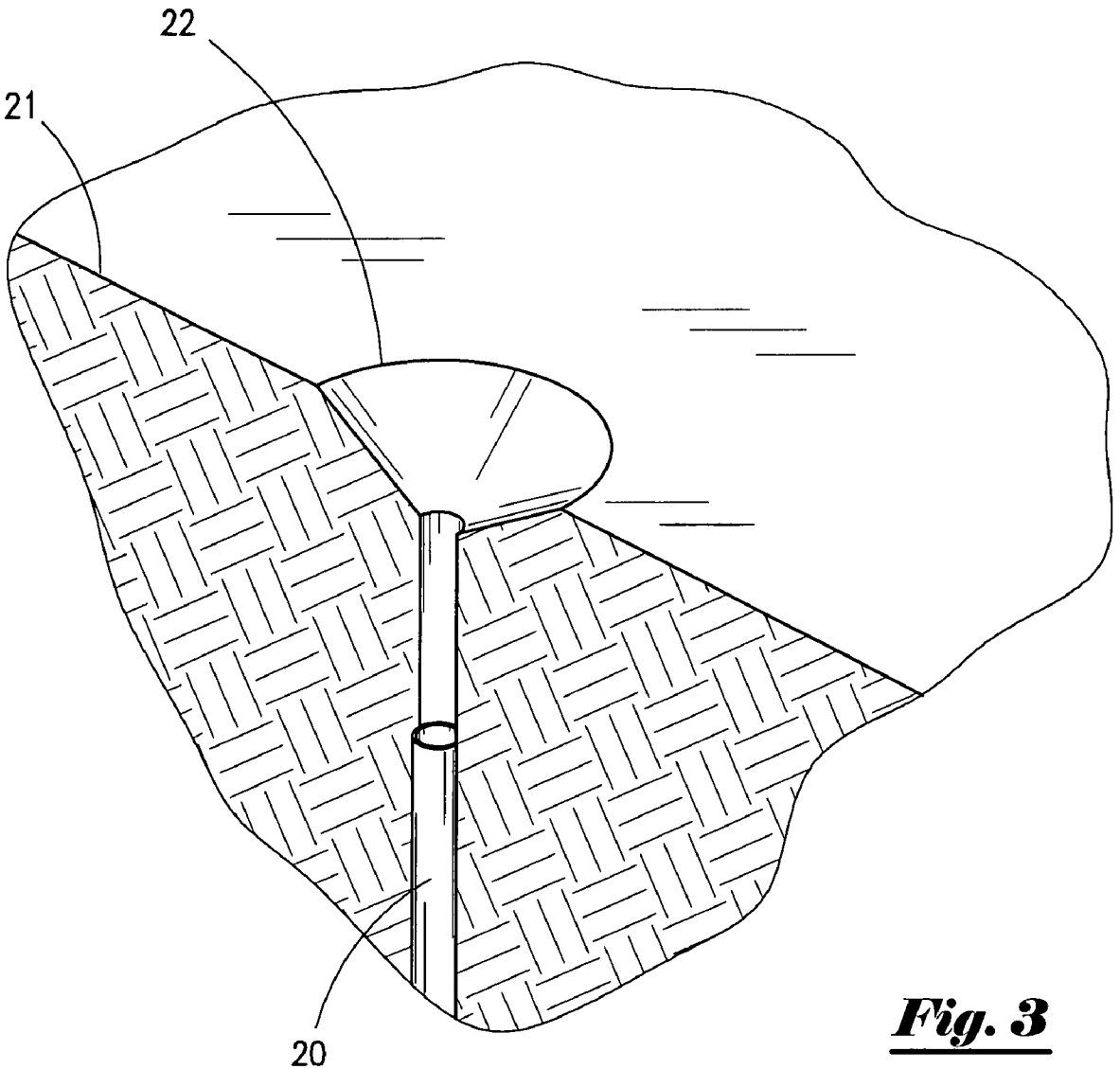
FIG. 3 depicts an overhead perspective sectional view of a damaged well that has been cut below the mud-line in accordance with the method of the present invention.

FIG. 3 depicts an overhead perspective view of damaged well 20 after it has been cut below mud-line 21. Such cutting can be accomplished using any number of different methods well known in the art. Further, in many cases (especially when well 20 is cut below mud-line 21), mud and/or other debris surrounding a well can be beneficially removed or excavated from the area around the outer surface of well 20 in order to provide access to such well. Frequently, such mud removal and cutting operations are performed by divers, remote operated equipment, or some combination of divers and equipment. In some cases, a well such as well 20 must be cut in stages—that is, the well is first cut using external cutting means above the mud-line, and thereafter cut below the mud-line using internal cutting means.

As set forth above, although not depicted in the accompanying drawings, many wells comprise multiple concentric strings of pipe—that is, for example, drive pipe, casing, tubing and/or other similar pipe. In most cases, all concentric pipe strings present at a desired cut point in a well are severed at such depth. Accordingly, a well's original drive pipe (which typically constitutes the outermost string of pipe), as well as any casing and/or tubing strings situated within said drive pipe, are all cut at a desired depth. Following such cut, the upper end of said well at the location of the cut comprises an upward-facing opening.

Figure 4:
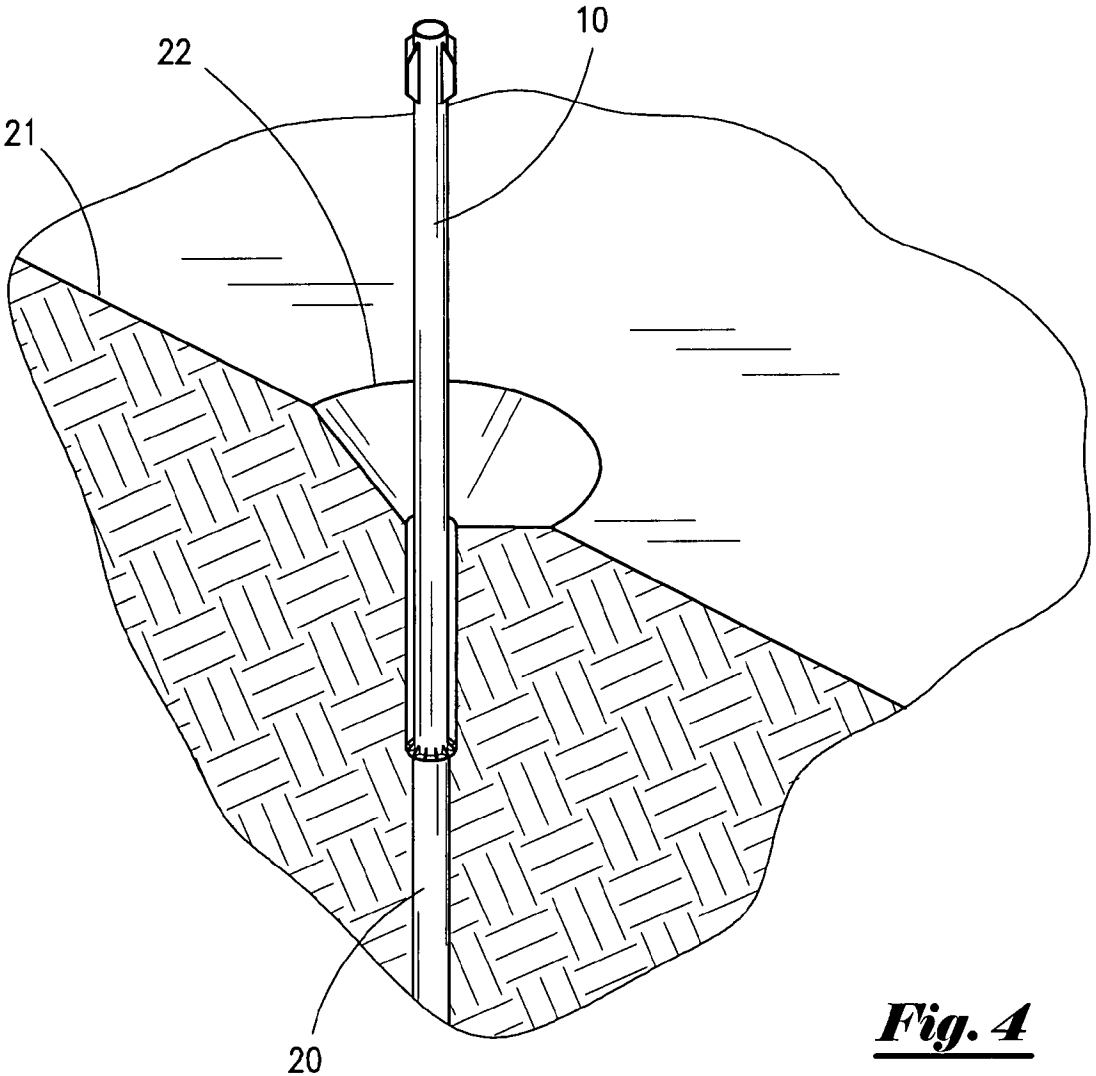
FIG. 4 depicts an overhead perspective sectional view of a damaged well with the alignment apparatus of the present invention installed.

Once well 20 has been cut at a desired depth, FIG. 4 depicts how alignment apparatus 10 of the present invention is typically "stabbed" into the upper opening of said well 20. Such alignment apparatus 10 can be handled and/or manipulated using a crane, hoist or other similar lifting equipment. However, in most cases, it is beneficial to use a drilling rig or other similar apparatus situated above such well 20 (not shown in the accompanying drawings).

Although it may be possible to steer the elongated spear member 14 of alignment apparatus 10 into the upper opening of well 20, in many cases it is necessary to employ divers, remote-operated equipment, or some combination thereof, to position the alignment apparatus over well 20 and guide the spear member into the upper opening of said well 20. In most cases, alignment apparatus 10 of the present invention (and, more particularly, elongated spear member 14) is received within well 20 until planar plate member 12 contacts the upper (severed) surface of said well 20. In this configuration, alignment apparatus 10 of the present invention extends vertically upward from the upper surface of well 20.

Figure 5:
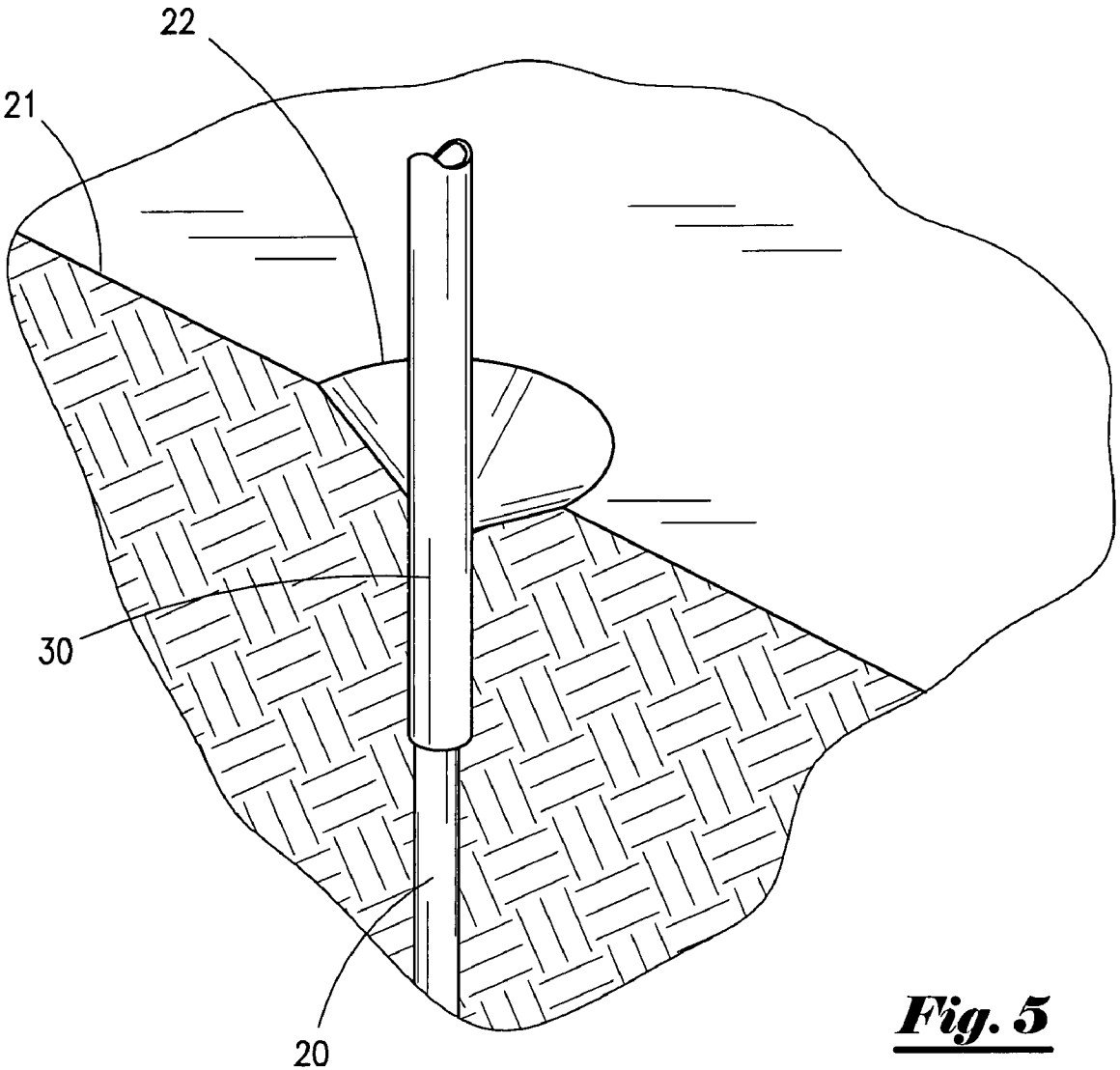
FIG. 5 depicts an overhead perspective sectional view of large diameter drive pipe being installed over a damaged well in accordance with the method of the present invention.

FIG. 5 depicts an overhead perspective sectional view of large diameter drive pipe 30 being installed over damaged well 20 in accordance with the method of the present invention. After the alignment apparatus 10 of the present invention is concentrically stabbed into the upper opening of well 20 as set forth above, large diameter pipe 30 (that is, pipe having an internal diameter sufficiently large to fit over the outer diameters of both alignment apparatus 10 of the present invention and the original drive pipe of well 20) is positioned over alignment apparatus 10. Said drive pipe is then driven over said alignment apparatus 10 and a portion of well 20 using conventional pipe-driving methods well known by those having skill in the art. In most cases, large diameter pipe 30 is driven using a conventional drilling rig or other similar equipment situated over well 20. During such pipe driving operations, alignment apparatus 10 serves as a guide to align such large diameter pipe 30 over the upper portion of well 20.

After pipe 30 has been driven over the upper portion of well 20, alignment apparatus 10 of the present invention (which, at this point, is located concentrically within such pipe 30) is retrieved using a drilling rig, crane or other surface equipment. Such new pipe 30 provides a conduit into well 20 from a rig or other surface equipment for reclamation activities such as, for example, remedial downhole operations in well 20. Such remedial operations include, but are not necessarily limited to, retrieving or "fishing" existing pipe or other equipment, and/or installing new pipe or other downhole equipment. Additionally, such new pipe 30 provides structural integrity to well 20 to support future utility of such well.

Figure 6:
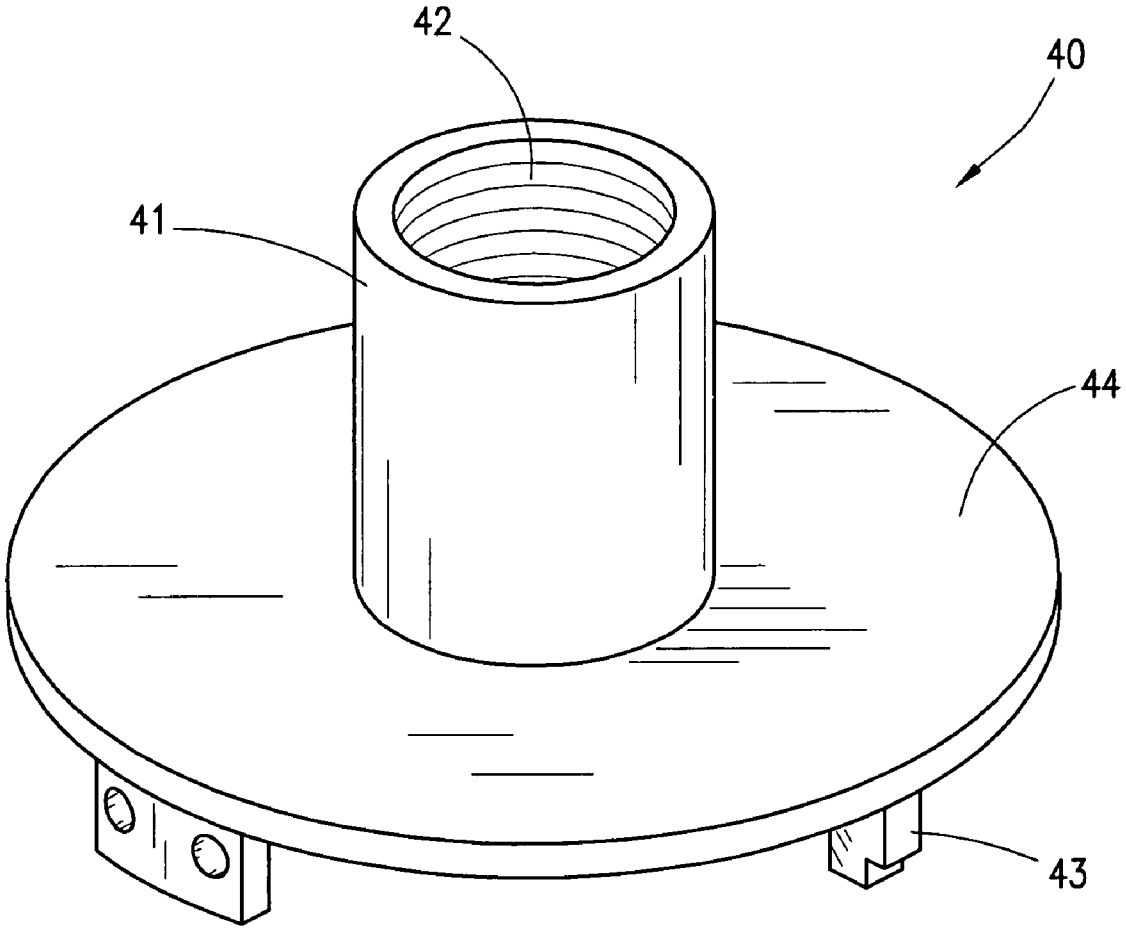
FIG. 6 depicts an overhead perspective view of a cap of the present invention.

FIG. 6 depicts an overhead perspective view of a cap 40 of the present invention. Cap 40 can be optionally installed on upper surface 11*a* of alignment apparatus 10. In the preferred embodiment, cap 40 comprises substantially planar plate member 44. Connection adaptor 41 is mounted to the upper surface of plate member 44. In the preferred embodiment, connection adaptor 41 has a central bore 42 and internal threads (not shown in FIG. 6) disposed along the inner surface of said connection adapter. Extension member 43 extends outward from the lower surface of cap 40, and is configured to fit within and mate with notch 18 disposed along upper surface 11*a* of alignment apparatus 10.

If desired, cap 40 can be connected to the upper surface of alignment apparatus 10. When installed, said cap 40 provides a cover to prevent debris or other materials from entering into the internal bore of body member 11. Further, said cap 40 and, more particularly, connection adaptor 41 permit threadable connection of drill pipe or other tubular worksting to alignment apparatus 10. Such drill pipe and/or workstring can be utilized to convey alignment apparatus from a rig or other surface equipment location to its intended position within well 20. Further, because extension member 43 mates within notch 18, rotational torque can be applied to said alignment apparatus 10 (typically via conveying drill pipe or tubular workstring) to help manipulate or work said alignment apparatus 10 into a desired location.

Although preferred embodiments of the subject invention have been described herein, it should be understood that various changes, adaptations and modifications may be made therein without departing from the spirit of the invention and the scope of the appended claims.

What is claimed:

1. A method for repairing a damaged well having a bend near its upper end comprising the steps of:

a) cutting said well below said bend to define an upper opening of said well:

b) placing an alignment apparatus in said upper opening of said well, wherein said alignment apparatus further comprises:

i) a substantially cylindrical body member having an upper end and a lower end ii) a substantially planar plate member having a top, a bottom and an outer diameter, wherein said top is connected to said lower end of said substantially cylindrical body member, and said substantially planar plate is oriented perpendicular to the longitudinal axis of said substantially cylindrical body member;

iii) an elongate extension having an upper end, a lower end and an outer diameter, wherein said upper end is connected to the bottom of said plate, and said elongate extension has a smaller outer diameter than the outer diameter of said substantially planar plate member; and iv) at least one fin, wherein said at least one fin extends radially outward from said elongate extension, and is oriented substantially parallel to the longitudinal axis of said elongate extension;

c) installing pipe around said alignment apparatus and a portion of said well; and d) removing said alignment apparatus from said pipe.

2. The method of claim 1, wherein said alignment apparatus further comprises a cap having an upper surface and a lower surface, wherein said cap is removably attached to the upper end of said substantially cylindrical body.

3. The method of claim 2, wherein said cap further comprises a threaded connection disposed on the upper surface of said cap.

4. A method for repairing a damaged well having a bend near its upper end comprising the steps of:

a) excavating earth from the outer surface of said well below said bend;

b) cutting said well below said bend to define an upper opening of said well;

c) placing an alignment apparatus in said upper opening of said well, wherein said alignment apparatus further comprises:

i) a substantially cylindrical body member having an upper end and a lower end;

ii) a substantially planar plate member having a top, a bottom and an outer diameter, wherein said top is connected to said lower end of said substantially cylindrical body member, and said substantially planar plate is oriented perpendicular to the longitudinal axis of said substantially cylindrical body member;

iii) an elongate extension having an upper end, a lower end and an outer diameter, wherein said upper end is connected to the bottom of said plate, and said elongate extension has a smaller outer diameter than the outer diameter of said substantially planar plate member; and iv) least one fin, wherein said at least one fin extends radially outward from said elongate extension, and is oriented substantially parallel to the longitudinal axis of said elongate extension;

d) installing pipe around said alignment apparatus and a portion of said well;

e) removing said alignment apparatus from said pipe; and f) conducting operations in said well.

5. The method of claim 4, wherein said alignment apparatus further comprises a cap having an upper surface and a lower surface, wherein said cap is removably attached to the upper end of said substantially cylindrical body.

6. The method of claim 5, wherein said cap further comprises a threaded connection disposed on the upper surface of said cap.

* * * * *